US005193860A

United States Patent [19]

Dolman

[11] Patent Number: 5,193,860

[45] Date of Patent: Mar. 16, 1993

[54] CLOSURE LOCKING MECHANISMS

[75] Inventor: Terry J. Dolman, Walmley, England

[73] Assignee: Feneseal Limited, Tipton, England

[21] Appl. No.: 828,566

[22] Filed: Jan. 31, 1992

[30] Foreign Application Priority Data

Feb. 1, 1991 [GB] United Kingdom ..... 9102218
Mar. 8, 1991 [GB] United Kingdom ..... 9104945

[51] Int. Cl.[5] ..... E05C 9/04
[52] U.S. Cl. ..... 292/39; 292/DIG. 60
[58] Field of Search ..... 74/422, 89.17, 501.6; 292/39, 51, 160, 142, 172, 199, 112

[56] References Cited

U.S. PATENT DOCUMENTS

| | | | |
|---|---|---|---|
| 1,203,394 | 10/1916 | Ottinger | 292/DIG. 72 X |
| 1,378,622 | 5/1921 | Sarbij | 292/142 |
| 2,532,630 | 12/1950 | Lickteig | 292/142 |
| 2,787,154 | 4/1957 | Wesberry | 292/39 X |
| 2,943,514 | 7/1960 | Golde | 74/501.6 X |
| 3,063,305 | 11/1962 | Ensinger | 74/501.6 X |
| 3,174,742 | 3/1965 | Stelzer | 74/89.17 X |
| 4,919,005 | 4/1990 | Schleicher | 74/501.6 |

FOREIGN PATENT DOCUMENTS

| | | |
|---|---|---|
| 140374 | 3/1949 | Australia . |
| 0292665 | 11/1988 | European Pat. Off. . |
| 3901957 | 7/1990 | Fed. Rep. of Germany . |
| 2370202 | 6/1978 | France . |
| 2532355 | 3/1984 | France . |
| 2600127 | 12/1987 | France . |

*Primary Examiner*—Richard E. Moore
*Attorney, Agent, or Firm*—Leydig, Voit & Mayer

[57] ABSTRACT

A locking mechanism for a closure such as a window comprises a body containing a gear wheel that is rotated by a handle. This rotation is converted to a locking action by actuating members which are provided with a helical thread which engages helical teeth on the gear wheel. Rotation in one sense throws the members out of the body to perform a locking action and reverse rotation retracts the members into the body in an unlocking action. The position of the members can be altered simply by screwing the members into and out of the body.

8 Claims, 2 Drawing Sheets

CLOSURE LOCKING MECHANISMS

BACKGROUND TO THE INVENTION

1. Field of the Invention

The invention relates to locking mechanisms for closures where a panel is movable into and out of a closed disposition relative to a frame. Examples are doors and windows.

2. Brief Review of the Prior Art

In closures such as sash windows, it is increasingly common to find on the sash a locking mechanism which, when the sash is closed into the frame, is operable to lock the sash to the frame. Such mechanisms are usually operated by rotating a handle which is also used to open and close the sash. The rotational movement of the handle is transmitted into a locking movement by, for example, a rack or racks with spaced teeth normal to its length which is driven by a pinion having teeth lying in planes including the pinion axis. An example of such an arrangement is shown in Australian Patent Specification No. 140374.

SUMMARY OF THE INVENTION

According to the invention, there is provided a window locking mechanism for a closure in which a panel member is movable into and out of a closed disposition relative to a frame member comprising a body for mounting on one member of the closure, a gear wheel mounted on the body for rotation by a handle, and an actuating member projecting from the body for connection to a bolt, the actuating member being elongated and including a helical thread extending around the member, the helical thread so meshing with the gear wheel that rotation of the gear wheel in one sense extended the actuating member out of the body and rotation of the gear wheel in a sense opposite to said one sense retracts the actuating member into the body so, in use, moving the bolt between locked and unlocked positions.

Thus, the invention provides an alternative way of converting the rotation of a handle into movement of the bolts. By the use of a helical thread, the extended and retracted positions of the bolt can be adjusted simply by rotating the actuating members so allowing, when the mechanism has been installed in a closure, accurate positioning of the bolts to ensure positive locking.

The following is a more detailed description of an embodiment of the invention, by way of example, reference being made to the accompanying drawings in which:

DESCRIPTION OF THE PREFERRED EMBODIMENTS

Figure 1:
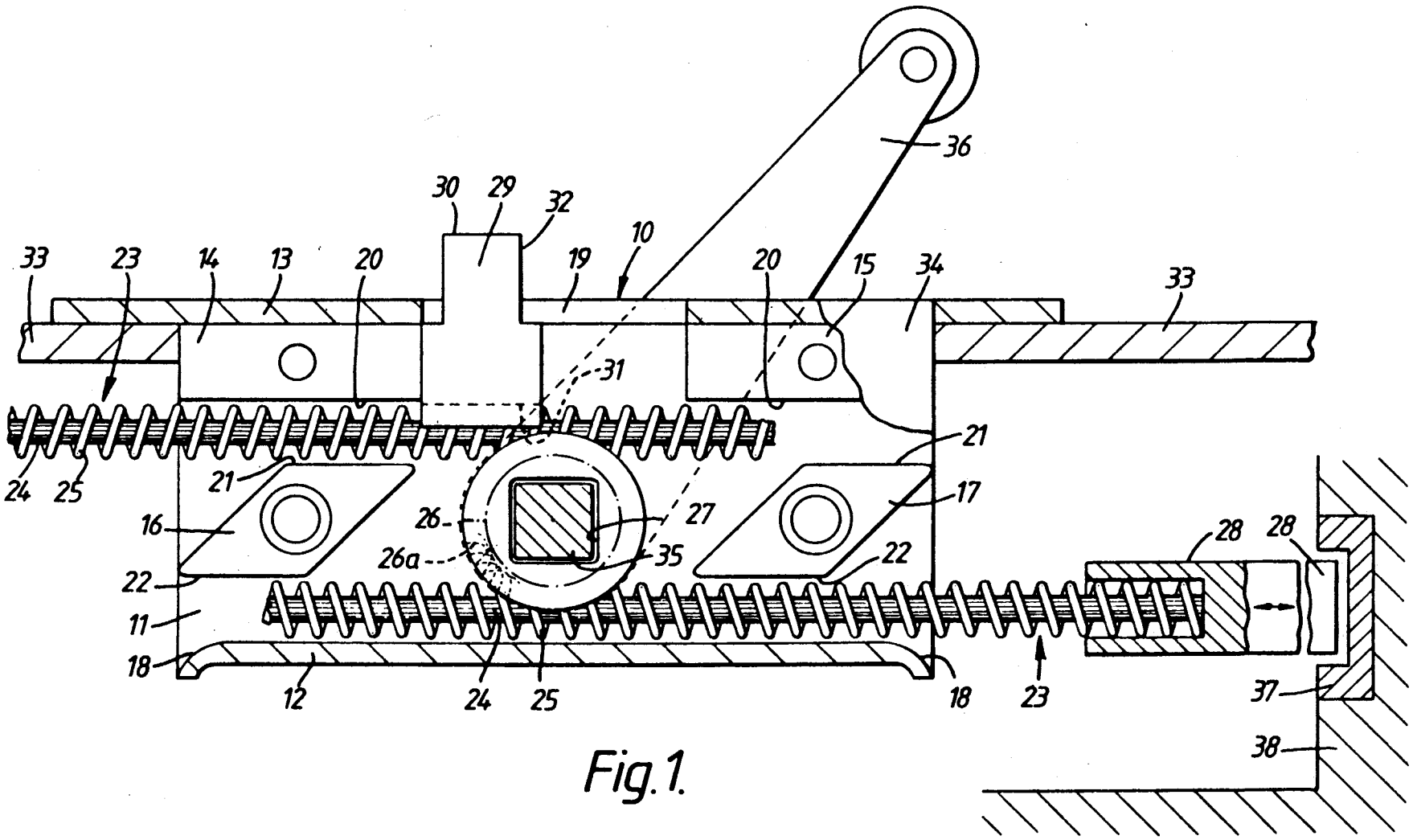
FIG. 1 is a cross-section of the frame of a window sash carrying a window-locking mechanism shown with the top plate removed and with portions of the mechanism in section.

Referring first to FIG. 1, the mechanism comprises a body 10 which is moulded from a high strength plastics material and includes a base plate 11. A rear wall 12 and a front wall 13 project from the base plate 11 and the base plate also carries guide blocks 14, 15, 16 and 17.

The rear wall 12 is continuous along the length of the base plate 11 and is provided with outwardly splayed ends 18. The front wall 13 extends beyond the ends of the base plate 11 to provide flanges by which the mechanism can be fixed to the frame 33 of a window sash. The front wall 13 has a slot 19 of reduced height for a purpose to be described below.

Two of the guide blocks 14,15 are generally rectangular in plan and abut the front wall 13. These guide blocks 14,15 have rear faces 20 which are co-planar and which extend normal to the base plate 11.

The two remaining guide blocks 16,17 are rhomboidal in plan. They have front faces 21 which are co-planar and which extend normal to the base plate 11 and rear faces 22 which are co-planar and which extend normal to the base plate 11.

The rear faces of the first guide blocks 14,15 and the front faces 21 of the rhomboidal guide blocks 16,17 are thus parallel but spaced and form a guide channel. A second guide channel is formed by the rear faces 22 of the rhomboidal guide blocks 16,17 and the rear wall 12, and is parallel to the first guide channel.

Each of these channels receives an actuator member 23 formed by an elongate core 24 of parallel wire strands surrounded by a wire 25 extending helically along the core 24 with gaps between successive turns to form a helical thread.

The inner ends of the members 23 are received in the channels while the outer ends of the members 23 project from the body 10. The outer ends of the members 23 carry bolts, one of which is shown at 28.

A gear wheel 26 is mounted on the base plate 11 and is provided with a central passageway 27 of square cross-section. The gear wheel 26 has a periphery which is generally concave in cross-section in planes including the gear wheel axis so that, as seen in the Figure, the inner portions of the members 23 are partially received within the concave periphery. The periphery is also provided with part-helical teeth 26*a* which mesh with successive turns of the helical wire 25 on the members.

A lock 29 is also provided and is formed by a block 30 which is located between the guide blocks 14,15 in the portion 19 of the front wall 13 of reduced height. The lock has an end face 31 which is concave and which embraces the inner end of one of the members 23. A projecting portion 32 of the lock 29 allows the lock 29 to be slid between the guide blocks 14,15 to a position in which the inner end of the associated member 23 is gripped between the lock 29 and the gear wheel 26 so preventing movement of the member 23 and, consequently, movement of the gear wheel 26 and movement of the other member 23. This therefore operates the lock.

Figure 2:
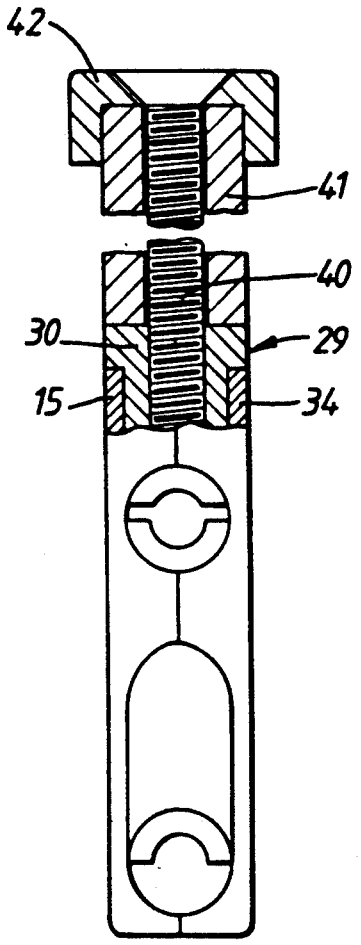
FIG. 2 is an end view, partly in section, of a mechanism of the kind shown in FIG. 1 but with a modified form of lock for locking the mechanism.

A modification of the lock 29 is shown in FIG. 2. Parts common to FIG. 1 and to FIG. 2 will be given the same reference numerals and will not be described in detail.

In the modification, a screw 40 extends upwardly from the block 30 and is surrounded by a bush 41. A roller 42 is in threaded engagement with the screw 40 and is used to operate the lock 29. By adjusting the length of the screw 40 and the bush 41, the height of the roller 42 can be adjusted to allow for manufacturing inaccuracies in the associated frame 33.

In use, the body is closed by a top plate 34. A square section rod 35 passes through the passageway 27 and the gear wheel 26 and a handle 36 is fixed to one end of the rod. This handle can be used to open and close the sash into a co-operating fixed frame, when the mechanism is mounted on a sash frame.

When closed in the frame, and with the lock 29 in the unlocked position shown in the Figure, the handle can be rotated. If the rotation is in an anti-clockwise direction as viewed in FIG. 1, the gear wheel 26 rotates in an anti-clockwise direction and, by virtue of the meshing engagement between the gear wheel 26 and the members 23, moves the members 23 in the guide channel to extend the actuating members 23 out of the body 10. This moves the bolts, one of which is shown at 28, into positions in which they engage keepers 37 in the fixed frame 38. In this way, the sash is locked to the fixed frame 38. Reverse rotation (clockwise rotation as viewed in FIG. 1) causes the actuating members to be retracted into the body. This disengages the bolts 28 from the keepers 37 and allows the sash to be opened.

If, when the locking mechanism is fitted to the sash 33, the bolts 28 do not properly engage with the keepers 37, then the position of the bolts 28 can be adjusted by rotation of the associated member 23. This simply screws the member 23 into or out of the body so allowing the bolt 28 to be accurately positioned.

It will be appreciated that the mechanism described above with reference to the drawings is not complicated and so is reliable in use. It is also inexpensive and easy to manufacture, giving reliable operation. If there is any malfunction of the members 23, they can readily be replaced by simply unscrewing them out of the body and screwing in new members. The members 23 can have a left or right-hand thread, as required.

It will also be appreciated that the actuating members need not be constructed as described above. There could, for example, be rods machined to provide the helical thread.

Although the embodiment shown in the drawings has been described in relation to a sash window, it will be appreciated that it may be applied to any closure where a panel is movable into and out of a closed disposition relative to a frame. Examples are doors, patio doors and roof lights. The mechanism may be mounted on the panel or the frame.

What is claimed is:

1. A window locking mechanism for a closure in which a panel member is movable into and out of a closed disposition relative to a frame member comprising a body for mounting on one member of the closure, a gear wheel mounted on the body for rotation by a handle, and an actuating member projecting from the body for connection to a bolt, the actuating member being elongated and including a helical thread extending around the member, the helical thread so meshing with the gear wheel that rotation of the gear wheel in one sense extends the actuating member out of the body and rotation of the gear wheel in a sense opposite to said one sense retracts the actuating member into the body so, in use, moving the bolt between locked and unlocked positions.

2. A locking mechanism according to claim 1 wherein the gear wheel has a periphery which is generally concave in cross-section in planes including the gear wheel for receiving a portion of the actuating member, the teeth of the gear wheel having a part-helical profile for meshing with the helical thread on the actuating member.

3. A locking mechanism according to claim 1 wherein the body includes guides which define the path of movement for the actuating member.

4. A locking mechanism according to claim 1 wherein a lock is provided which is operable to prevent rotation of the gear wheel so preventing the bolt being moved from the locked position.

5. A locking mechanism according to claim 4 wherein the lock includes a slider movable between a first, inoperative position and a second position in which the slider engages the actuating member, so preventing movement of the member and thus movement of the gear wheel.

6. A locking mechanism according to claim 5 wherein the lock includes operating means comprising a screw projecting from the slider and surrounded by a bush, a roller being connected to said screw.

7. A locking member according to claim 1 wherein the actuating member comprises an elongate core surrounded by a wire extending in spaced turns helically along the core, adjacent turns of the wire forming the helical thread.

8. A locking member according to claim 1 wherein two actuating members are provided, each for connection to an associated bolt and projecting from the body in opposite directions, the helical threads of the two actuating members meshing with respective opposite portions of the gear wheel so that rotation of the gear wheel moves the actuating members in respective opposite directions.

* * * * *